United States Patent [19]

Verville

[11] 4,121,399

[45] Oct. 24, 1978

[54] METHOD AND APPARATUS FOR PACKAGING COMPRESSIBLE MATERIAL INTO FLEXIBLE-WALLED CONTAINERS

[76] Inventor: Emile Verville, 429 St-Alfred St., Drummondville, Quebec, Canada, J2C 4A8

[21] Appl. No.: 808,714

[22] Filed: Jun. 21, 1977

[51] Int. Cl.[2] ..... B65B 1/24

[52] U.S. Cl. ..... 53/436; 53/527; 100/223

[58] Field of Search ..... 53/24, 124 B; 100/223

[56] References Cited

U.S. PATENT DOCUMENTS

| | | | |
|---|---|---|---|
| 646,355 | 3/1900 | Butler et al. | 53/124 B X |
| 1,163,465 | 12/1915 | Rose | 53/124 B |
| 3,754,503 | 8/1973 | Hennells | 53/124 B X |

FOREIGN PATENT DOCUMENTS

| | | | |
|---|---|---|---|
| 864,065 | 3/1961 | United Kingdom | 53/124 B |

*Primary Examiner*—Travis S. McGehee

*Attorney, Agent, or Firm*—Raymond A. Robic; Francis B. Francois; Arthur Schwartz

[57] ABSTRACT

A method for use in packaging compressible material in flexible-walled containers. The method comprises loading the container in a holding means having rigid means for confining the container to a desired, filled shape and then moving the holding means in sequence past work stations where the container is filled with compressible material, the material is compressed, the filled container is closed and the closed, filled container is removed from the holding means.

The invention also includes apparatus for carrying out the method.

20 Claims, 12 Drawing Figures

METHOD AND APPARATUS FOR PACKAGING COMPRESSIBLE MATERIAL INTO FLEXIBLE-WALLED CONTAINERS

This invention is directed toward a method, and an apparatus for carrying out the method, for packaging compressible material into flexible-walled containers.

Compressible material, such as loose insulation for example, is generally packaged in flexible-walled containers such as multi-walled, paper bags for example. The insulation is loaded into the bag and compressed therein so that a volume of the loose insulation, greater than the volume of the bag, can be packaged in the bag.

To package into a bag a volume of loose insulation greater than the volume of the bag, the bag is inserted into a tubular holder, and a tubular extension is then placed on top of the holder. Both the bag in the holder, and a portion of the tubular extension, is then filled with loose insulation. Means are then passed down through the tubular extension, into the top of the tubular holder to compress the loose insulation into the bag carried by the holder. The compressing means is then raised, the tubular extension is lifted, and the filled bag is removed from the tubular holder, and closed. An empty bag is then placed in the holder and the operation as repeated.

The packaging procedure is relatively slow since most of the operations are carried out at a single work station. In addition, the bag closing operation is manually done resulting in further inefficiencies.

It is the purpose of the present invention to provide a method for packaging compressible material into flexible walled containers which is faster than known methods. It is another purpose of the present invention to provide a method which is substantially mechanical in operation, thereby reducing the manual work required and increasing output per worker. It is a further purpose to provide a method which is substantially automatic in operation, thereby further increasing productivity.

An apparatus is provided for carrying out the method of the invention. The apparatus provides for substantially automatically filling a container with material, compressing the material therein, and closing the filled container. The apparatus is provided with a series of work stations at which the packaging steps are sequentially carried out and with means to automatically move a container, in intermittent sequence, past the work stations. The apparatus is relatively compact and simple in construction, and is readily operated by a single operator.

In accordance with the present invention there is provided a method for packaging compressible material in flexible-walled bags which comprises the steps of loading a flexible-walled container in a container holding means which has rigid means for confining the container to a desired, filled shape, and then moving the holding means in sequence past work stations where the container is filled with an excess of compressible material, the material is compressed, the filled container is closed, and the filled, closed container is removed from the holding means.

The holding means preferably is intermittently moved automatically in a circle past the work stations.

The container is preferably loaded in the holding means at the same work station where a filled, closed container has been unloaded.

The invention is also directed toward an apparatus for packaging compressible material in a flexible-walled container. The apparatus has means for holding an empty container with rigid means defining the desired filled shape of the container. The apparatus also includes means for moving the holding means to work stations where an empty container is loaded in the holding means, the container is filled with an excess of compressible material, the material is compressed into the container, the container is closed, and the closed, filled container is unloaded from the holding means.

The rigid means of the holding means comprise four rigid walls defining a quadrangular shape. Two adjacent walls form one wall unit and the other two adjacent walls form a second wall unit. The one wall unit is hinged to the second wall unit so the holding means can be opened up to be loaded or unloaded.

The invention is further directed toward an apparatus for packaging compressible material in flexible-walled containers which apparatus has a number of work stations with at least one different packaging operation performed at each station, and container holding means equal in number to the number of work stations. Each holding means has rigid means for defining the desired filled shape of the container and means are provided for moving each container holding means in sequence to each work station.

The invention will now be described in detail having reference to the accompanying drawings in which.

The packaging apparatus 1 of the present invention has means 3 for holding a container 5 to be filled with compressible material 7. The container 5 is a flexible walled bag made from one, or more, layers of suitable plastic or paper material. The compressible material 7 can comprise insulation, peat moss, wood shavings, asbestos, excelsior, woodbark or similar types of material.

Figure 1:
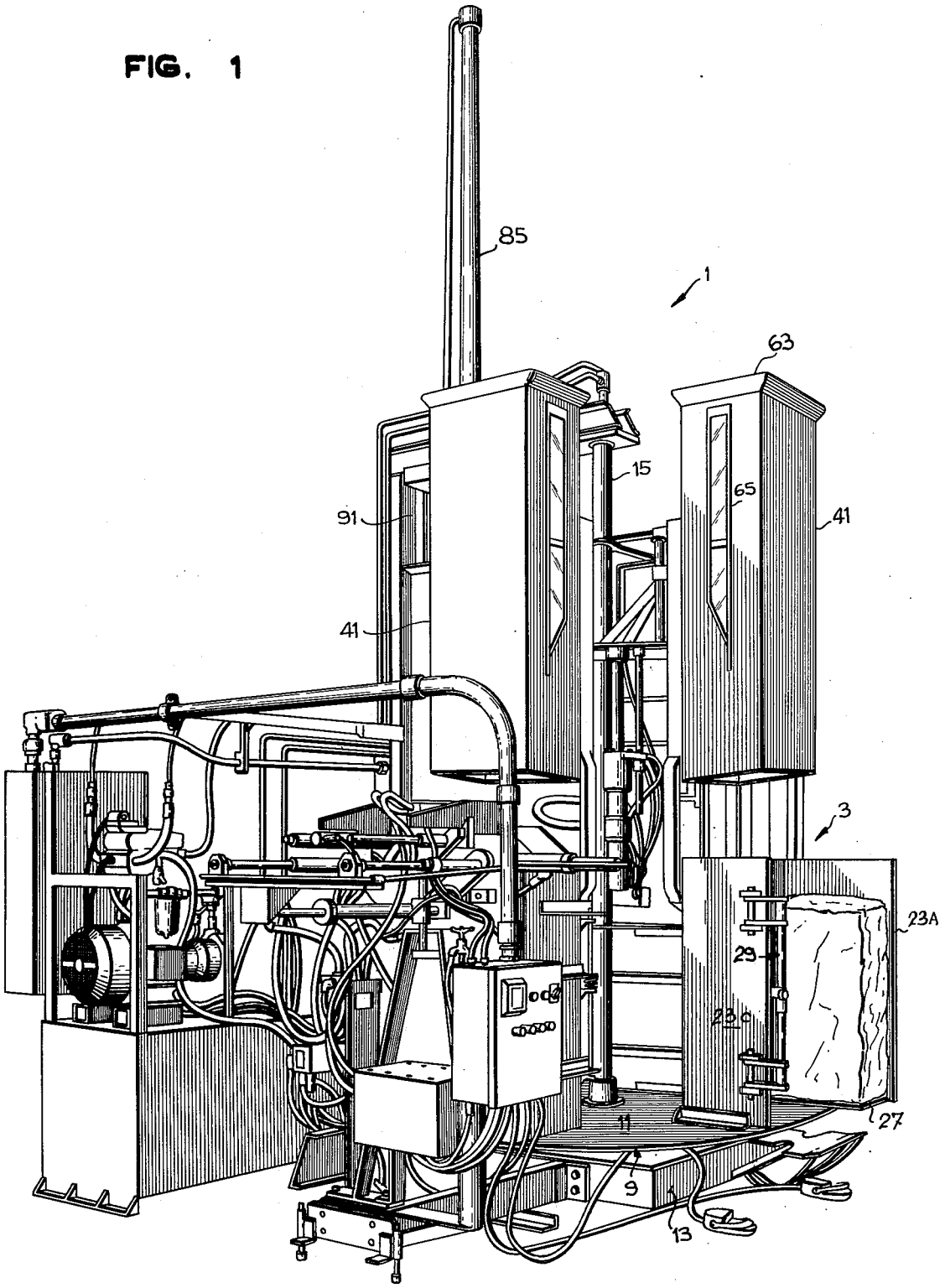
FIG. 1 is a perspective view of the compressible material packaging apparatus.
Figure 2:
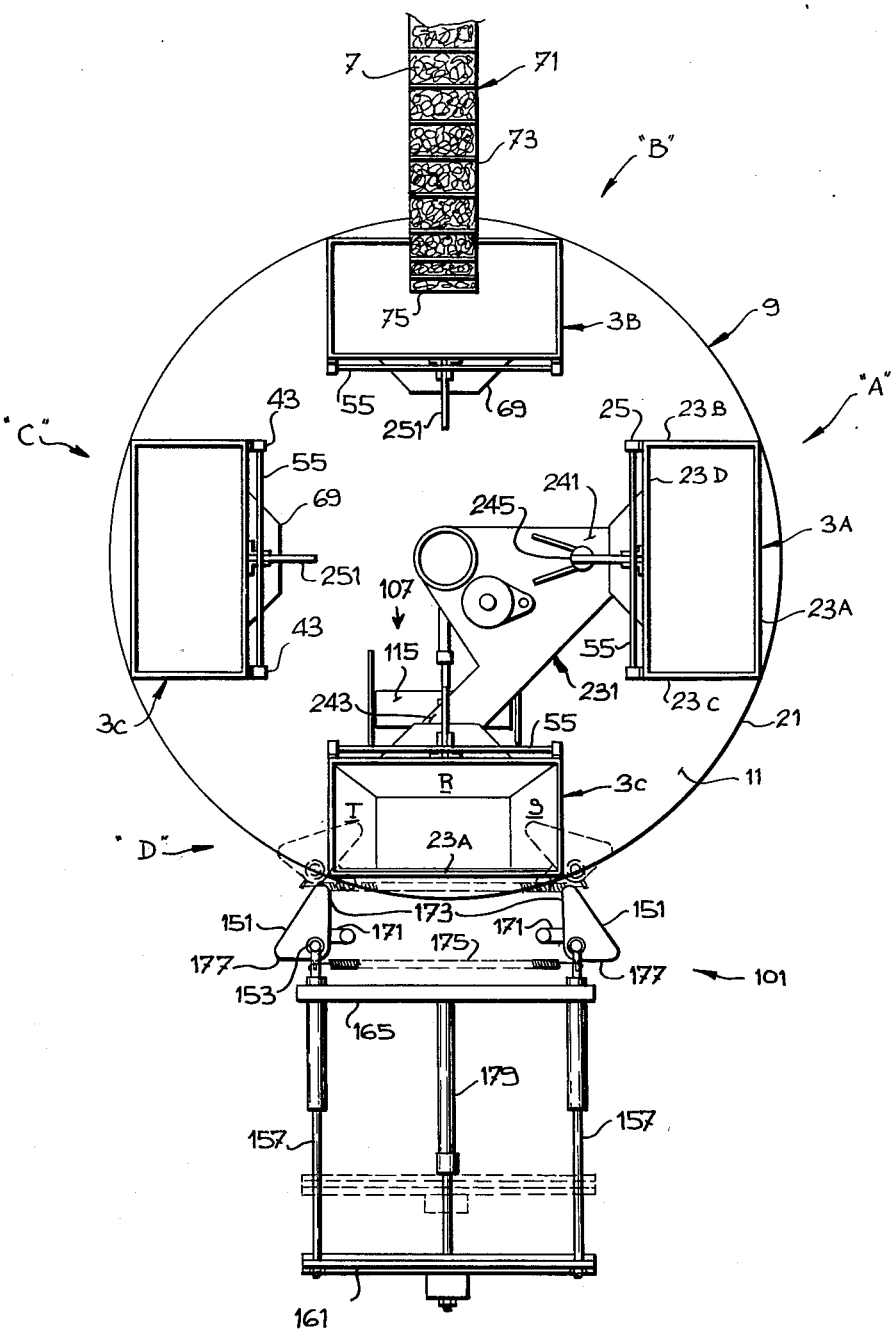
FIG. 2 is a partial plan view of the apparatus.
Figure 7:
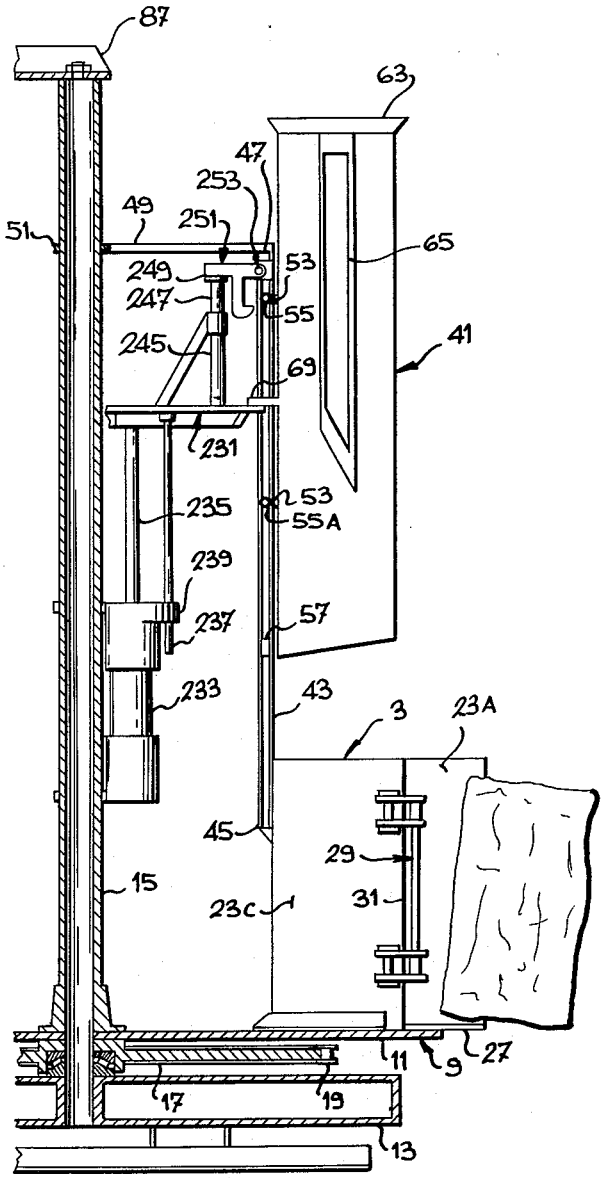
FIGS. 7 and 8 are detail views of the container loading and unloading station.

The container holding means 3 is mounted on a transporter 9 which carries the holding means 3 past a number of work stations. The transporter 9, as shown in FIGS. 2 and 7 preferably comprises a circular, horizontal platform 11 rotatably mounted on a base 13 for rotation about a fixed, central, vertical post 15. Gear means 17 are positioned beneath platform 11 and fixed thereto. The gear means 17 are driven by a chain drive 19 operated by a motor (not shown) to rotate platform 11 about post 15.

The container holding means 3 is preferably mounted adjacent the periphery 21 of the circular platform 11. The container holding means 3 is adapted to confine a container 5 in its desired packaged shape. The this end, holding means 3 has rigid, vertical side walls 23 defining the desired final packaged shape of the container 5 as shown in FIGS. 1, 2, 3 and 7. Preferably four side walls 23A, 23B, 23C and 23D are provided, normally arranged to define a rectangular shape. Front sidewall 23A, facing outwardly, is joined to one end side wall 23B and this two-walled unit, is hinged with hinge 25 along the free vertical edge of end sidewall 23B to the free vertical edge of back sidewall 23D. The front sidewall 23A and end sidewall 23B preferably carry a horizontal shelf 27 adjacent their lower edge, which, when walls 23A, 23B are closed, projects within the other side walls 23C, 23D. Shelf 27 can sit on circular platform 11. Means 29 are provided for clamping the sidewall 23A and sidewall 23B unit in its closed position. The clamping means 29 can be mounted adjacent the free vertical edge 31 of sidewall 23C lying opposite sidewall 23B. The clamping means 29 is manually operated to clamp sidewall 23A and 23B tight against edge 31 of sidewall 23C to close holding means 3. Each holding means 3 is open at the top.

A loading tube 41 is associated with each holding means 3. The loading tube 41 is located above holding means 3 and is slidably mounted on a pair of spaced-apart vertical guide beams 43. Beams 43 are attached at their lower end 45 to the back of sidewall 23D of holding means 3 and at their upper ends 47, by a brace 49 to a sleeve 51 rotatably mounted on the central fixed post 15. At least the lower end of the loading tube 41 is sized to fit closely within the top portion of holding means 3. Guide brackets 53 are provided on the back of tube 41, at this sides, cooperating with guide beams 43, to guide tube 41 vertically between one position within holding means 3, and a second position above holding means 3. Upper and lower pairs of guide brackets 53 are provided and horizontal guide rods 55 extend between each pair of guide brackets. The ends of each guide rod 55 may slide between the flanges of the guide beams 43. A stop 57 is provided in the lower part of each guide beam 43, adapted to cooperate with the ends of lower rod 55A to limit the extent of downward movement of tube 41.

The upper end 63 of loading tube 41 can be flared outwardly to facilitate loading of the compressible material into the tube as will be described. A vertical window 65 can be mounted in one sidewall 67 of loading tube 41 to permit operator observation of the filling operation. A horizontally disposed lifting plate 69 is mounted on the backwall 71 of loading tube 41, between guide rods 55. Means, to be described, cooperate with plate 69 to raise or lower loading tube 41.

The apparatus is provided with a number of identical holding means 3, each having a loading tube 41 associated with it. The holding means 3 are arranged in a circle on the platform 11, adjacent its peripheral edge 21. Preferably as shown in FIG. 2 four holding means 3A, 3B, 3C and 3D are provided on the platform spaced 90° apart. Each of the holding means 3A, 3B, 3C and 3D is moved in sequence past four work stations "A," "B," "C," and "D."

At the first work station "A," an empty container 5 is placed in the holding means 3 and loading tube 41 is lowered into the top portion of the holding means 3 to hold the mouth of container 5 open.

Figure 9:
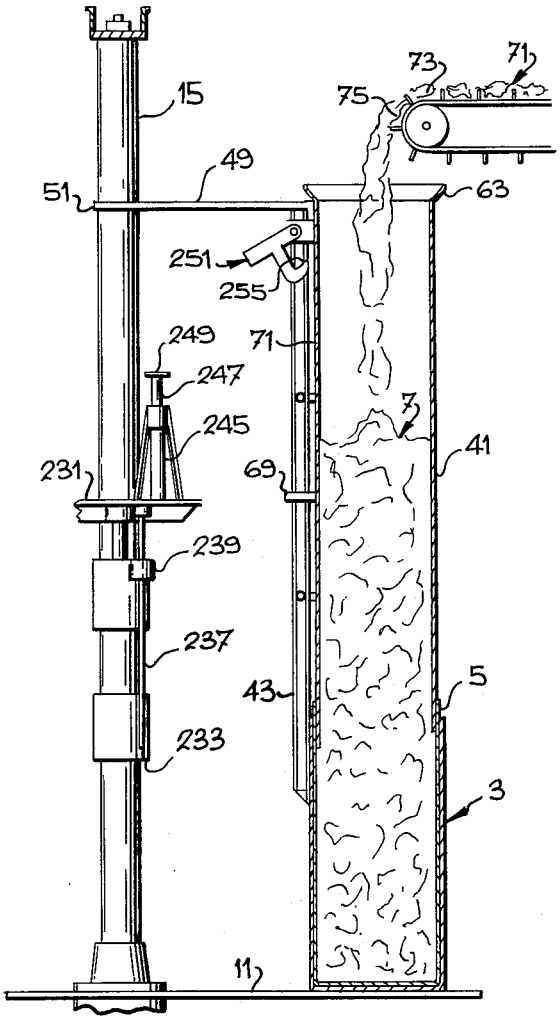
FIG. 9 is detail view of the filling station.

Material loading means 71 are located at the second work station "B," as shown in FIGS. 2 and 9 for transporting the compressible material 7 from a supply source (not shown) into the top of the guide tube. The loading means 71 can comprise a generally horizontal belt conveyor 73, supported by suitable framework (not shown), adjacent the apparatus. The discharge end 75 of the conveyor 73 is positioned over the upper flared end 63 of guide tube 41 when the tube is at station "B."

Figure 10:
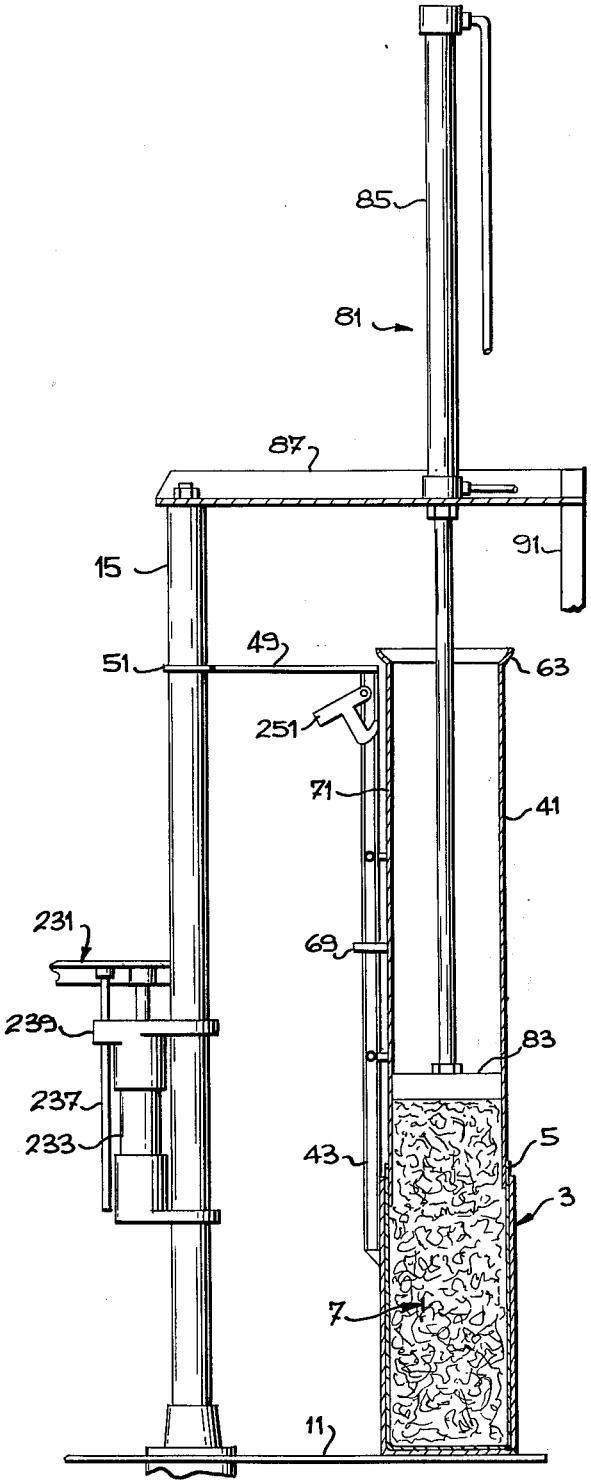
FIG. 10 is a detail view of the compressing station.

Compressing means 81 are located at the third work station "C," as shown in FIG. 10, for compressing the material, loaded into container 7 and tube 41 at station "B" down into the container 5 in holding means 3. The compressing means 81 can comprise a plunger 83 actuated by a double-acting, fluid pressure actuated cylinder 85. Cylinder 85 can be hydraulically or pneumatically operated, and is vertical mounted on a horizontal support beam 87 which is fixed at one end to the top 89 of fixed, central post 15. The other end of beam 87 can be fixed to the top of a vertical support beam 91 fixed at its lower end to base 13. Operation of cylinder 85 in one direction, lowers plunger 83 into tube 41 and down into folding means 3 to compress the material into the container 5. Operation of cylinder 85 in the opposite direction raised the plunger out of loading tube 41.

Container closing means 101 are provided at the fourth work station "D" for closing the container 5, now filled with the compressible material 7. The closing means 101 comprise means for tightly folding the open top of the container into a closed position, and means for fastening the folded container top in the closed position to keep it closed.

The container folding means comprise first folding means 107 for folding the top portion of backwall "R" of the container down horizontally onto the compressed material; second folding means 109 for folding the top portion of sidewalls "S," "T" of the container down toward each other and horizontally over the folded backwall "R" portion; and third folding means 111 for folding the top portion of front wall "U" down tightly over the folded sidewall "S," "T" portions.

Figure 3:
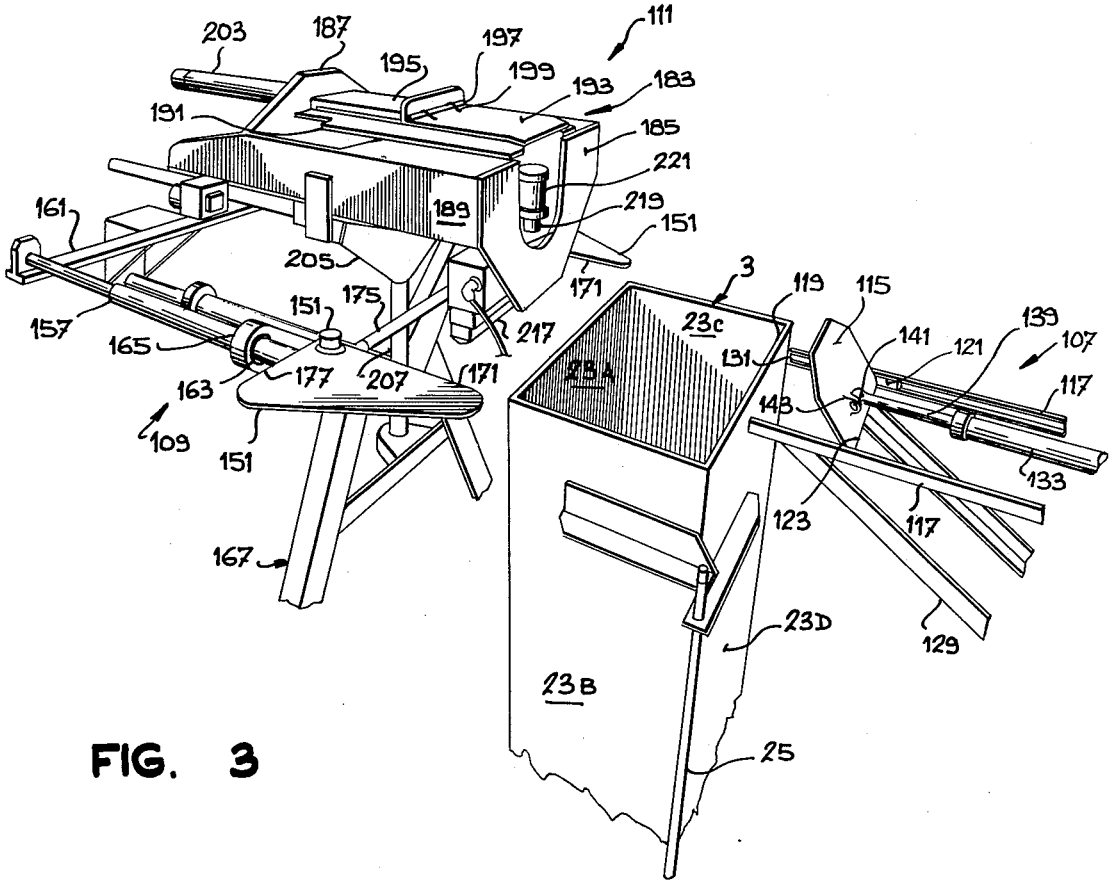
FIG. 3 is a detail perspective view of the container closing means.
Figure 4:
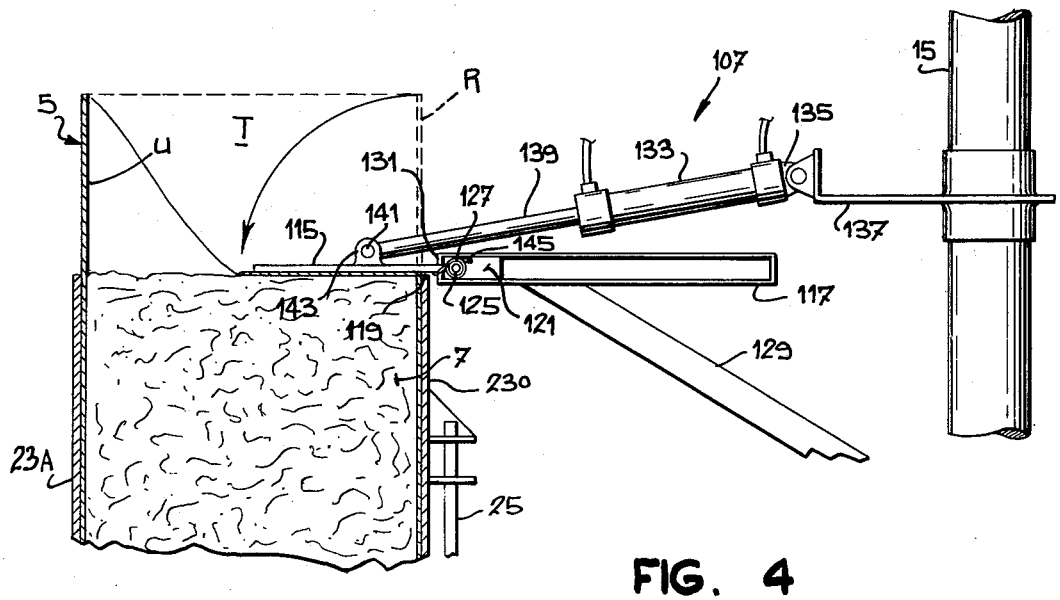
FIGS. 4, 5 and 6 are cross-sectional detail views of the container closing means in different states during closing of the container.

The first folding means 107, shown best in FIGS. 2, 3 and 4, has a generally rectangular folding plate 115 mounted between a pair of horizontal, parallel, slide tracks 117 which tracks extend toward the top edge 119 of backwall 23D of holding means 3 and terminate adjacent thereto. A runner 121 is slidably mounted in each track 117. The plate 115 is pivotably mounted to the runners 121 along its lower edge 123 by a rod 125 extending between the runners 121. The plate 115 has a pair of bushings 127 on its lower edge 123, at its corners, through which rod 125 passes. Plate 115 pivots about rod 125.

The tracks 117 are mounted by a support frame 129 fixed to post 15. Stop means 131 are provided at the ends of the slide tracks 117, adjacent holding means 3, for stopping outward movement of the runners 121. A double-acting, fluid pressure actuated cylinder 133 is mounted just above tracks 117. One end 135 of cylinder 133 is pivotably mounted to a support plate 137 fixed to post 15. The free end of the piston rod 139 of cylinder 133 is pivotably mounted by a pin 141 to a pair of lugs 143 on the back of plate 115. The lugs 143 are located generally in the center of the plate 115. A spring 145 can be provided on rod 125 arranged to bias plate 115 toward an upright position.

The second folding means 109 comprise a pair of generally triangular, horizontal plates 151 normally located in front of the holding means 3 at station "D." The plates 151, as shown in FIGS. 2, 3, 5 and 6, are positioned just above the top edge 119 of holding means 3 and on either side of front wall 23A of holding means 3. Each plate 151 is pivotably mounted by a vertical pin 153 at one corner thereof to one end 155 of horizontal guide rod 157. The outer end 159 of each guide rod 157 is fixed to a rear, cross-support bar 161. Each guide rod 157 slides horizontally through a bushing 163 mounted in a frame member 165 forming part of frame 167 fixed to base 13 adjacent platform 11.

A cam member 169 is mounted on each plate 151. The cam member 169 is positioned by a support arm 171 a short distance from the inside edge 173 of plate 151 and extends downwardly. A tension spring 175 extends between the back edges 177 of the plates 151. A double-acting, fluid pressure actuated cylinder 179 is mounted between cross-support bar 161 and frame 167 to move folding plates 151.

Figure 5:
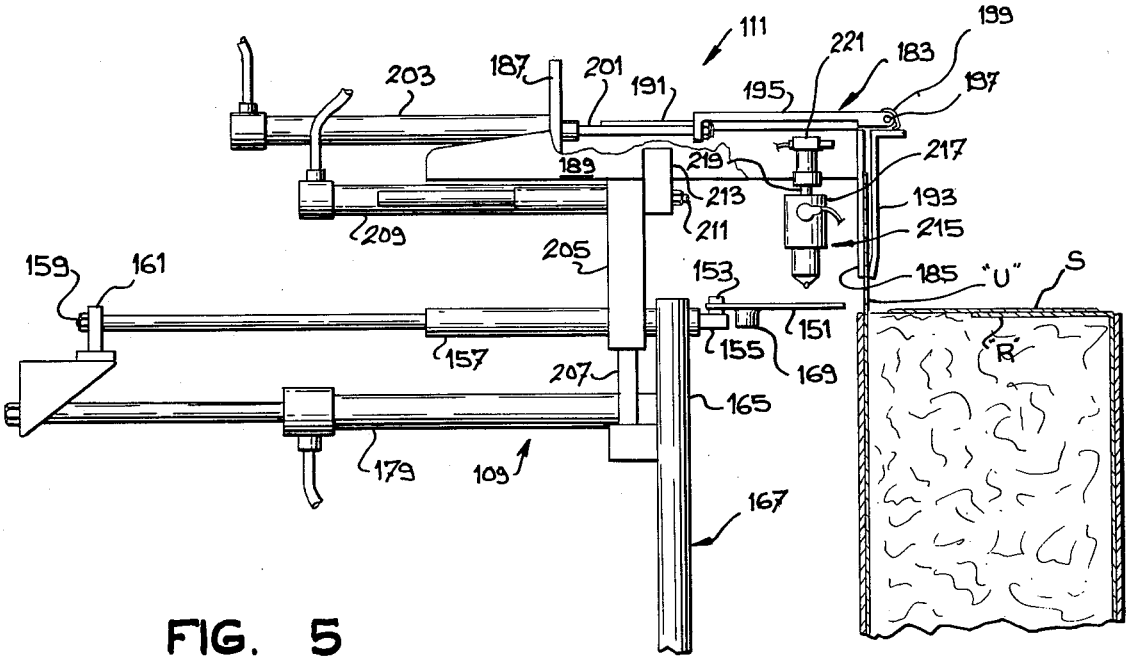
Figure 6:
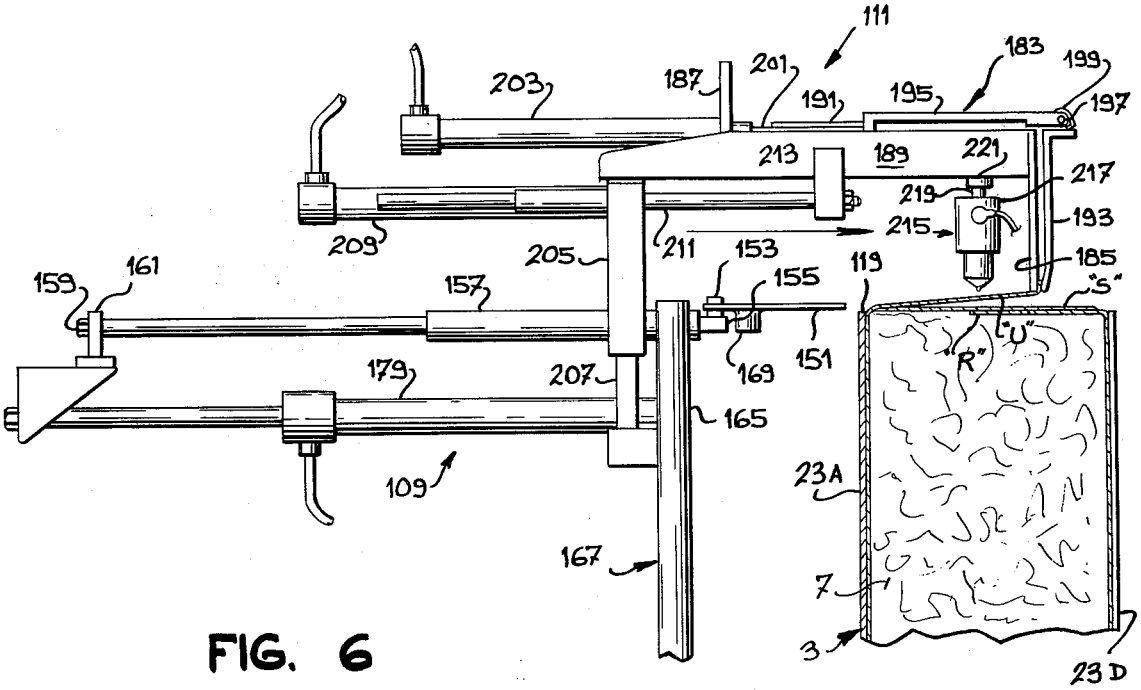

The third folding means 111 is also mounted on the support frame 167 above second folding means 109 as shown in FIGS. 3, 5 and 6. The third folding means 111 comprises a support assembly 183, consisting of a front plate 185, a back plate 187, side plates 189, and a top plate 191, all joined together by welding or other suitable means. The front plate 185 is vertical and lies adjacent the top portion "U" of the front wall of the container at station "D" and just above the front wall 23A of holding means 3. Back plate 187 is parallel to front plate 185, and side plates 189 and top plate 191 join the front and back plates together.

A spring biased clamping plate 193 is slidably mounted on top plate 191 of support assembly 183. The clamping plate 193 is pivotably connected to a guide plate 195 via a pin 197. The guide plate 195 is positioned behind clamping plate 193 and also slides on top plate 191. A spring 199 tends to bias clamping plate 193 clockwise about pin 197 as viewed in FIG. 5. The rear end of guide plate 195 is connected to the free end of the piston rod 201 of a horizontally positioned, double acting, fluid pressure actuated cylinder 203. The cylinder 203 is mounted on back plate 187 of support assembly 183.

Support assembly 183 is slidably mounted on a base member 205 which in turn is mounted on frame 167 by a vertical support post 207. A pair of horizontal, double acting, fluid pressure actuated cylinders 209 are mounted on the base member 205 as shown in FIGS. 5 and 6. The piston rods 211 of cylinders 209 pass through base member 205 and are connected at their free ends to brackets 213 depending down from the side plates 189 of support assembly 183.

Container sealing means 215 are carried by the support assembly 183. The sealing means 215 are positioned just behind front plate 185 of assembly 183, and can comprise a heat sealing unit 217 connected to the free end of a piston rod 219 of a vertically positioned, double acting, fluid pressure actuated cylinder 221. The cylinder 221 is mounted on assembly 183 between side plates 189, and beneath top plate 191. Actuation of cylinder 221 will lower the heat sealing unit onto a closed, plastic, container to seal it closed. A stapling unit could be used in place of heat sealing unit 217.

Figure 8:
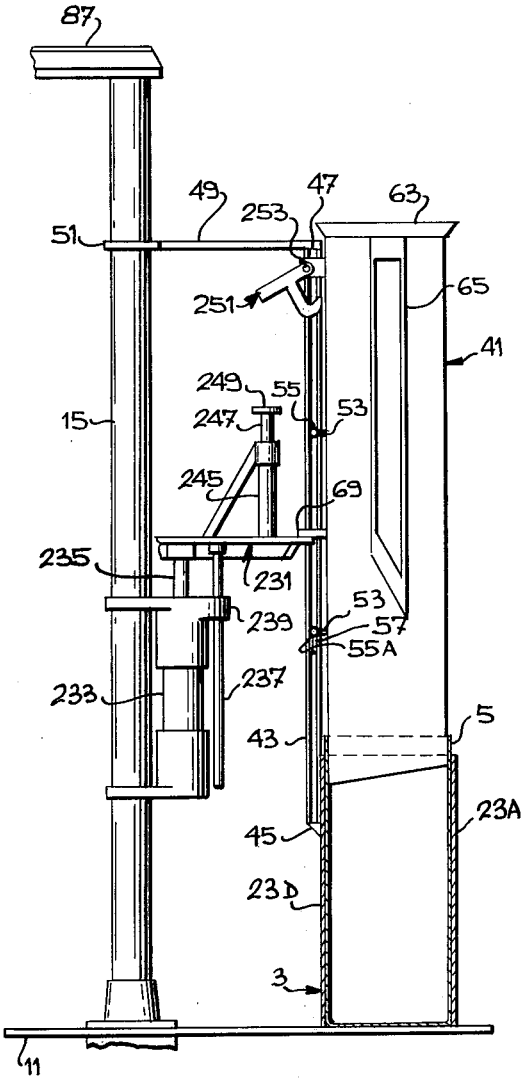

A horizontal lifting platform 231 is mounted on the apparatus between the fourth and first stations "D" and "A" as shown in FIG. 2. A double acting, fluid pressure actuated cylinder 233 is fixedly mounted in a vertical position beneath platform 231 as shown in FIGS. 7 and 8. The free end of piston rod 235 of cylinder 233 is connected to the bottom of platform 231. A vertical guide rod 237, parallel to piston rod 235, and spaced laterally therefrom, extends down from the bottom of platform 231 and slides through a bushing 239 carried by cylinder 233. The lifting platform 231 has a first lifting portion 241, adjacent the first work station "A" and a second lifting portion 243 adjacent the fourth work station "D." Another double-acting, fluid pressure actuated cylinder 245 is mounted in a vertical position on top of platform 231. Cylinder 245 is adjacent the first station "A" and the free end of its upwardly extending piston rod 247 carries a cam plate 249.

Loading tube retaining means 251 are pivotably mounted on the loading tube 41 near its top end. The retaining means 251 is, as shown in FIGS. 7 and 8, generally T-shaped and is mounted, by a pivot pin 253, to guide beam at one end of the cross bar of the "T." The lower end of the stem of the "T" has a hook portion 255 extending laterally therefrom in the same direction as the one end of the cross bar. When freely suspended from pin 253 the retaining means lies askew with hook portion 255 directly beneath pin 253, and in the path of movement of the upper cross rod 55 on loading tube 41.

In operation, the holding means 3 is manually opened up at work station "A" with the clamping means 29 unclamped and wall unit 23A, 23B pivoted open about hinge 25. Loading tube 41 is lowered into the top part of open holding means 3. The loading tube 41 is lowered along guide beams 43 by operating cylinder 233 to lower platform 231. As platform 231 is lowered, loading tube 41, supported by portion 241 of platform 231 through support plate 69, is also lowered until lower rod 55A hits stop 57 on the guide beams 43 stopping lowering of tube 41. Platform 231 is dropped slightly below plate 69. A bag or container 5, to be filled, is then placed in the open holding means 3 with its mouth drawn up around the bottom end of loading tube 41. The bottom end of loading tube 41 thus serves to hold the mouth of the container 5 open during filling. The holding means 3 is now closed, with shelf 27 sliding under the container 5, and clamped shut with clamp means 29. The apparatus 1, after loading the container, is shown in FIG. 8.

Platform 11 is then rotated counterclockwise about post 15, to move holding means 3, along with loading tube 41, from station "A" to station "B." At station "B," as shown in FIG. 9, the conveyor 73 is operated to loosely fill the container, and part of loading tube 41, with compressible material 7 through the open, flared top 63 of the tube. After filling, which can be observed through window 65, the platform 11 is again rotated to move the filled holding means 3 and tube 41 to station "C." At station "C," shown in FIG. 10, cylinder 85 is operated to lower plunger 83 into tube 41 and down into container 5 to compress the loose material within container 5. The material 7 is compressed to a shape defined by the rigid-walled holding means 3 with the container 5 conforming to this shape. Plunger 83 is then withdrawn from tube 41 and the holding means 3 and tube 41 is moved to station "D" by rotation of platform 11. In moving to station "D," lifting plate 69 on tube 41, is moved over portion 243 of stationary platform 231.

Figure 11:
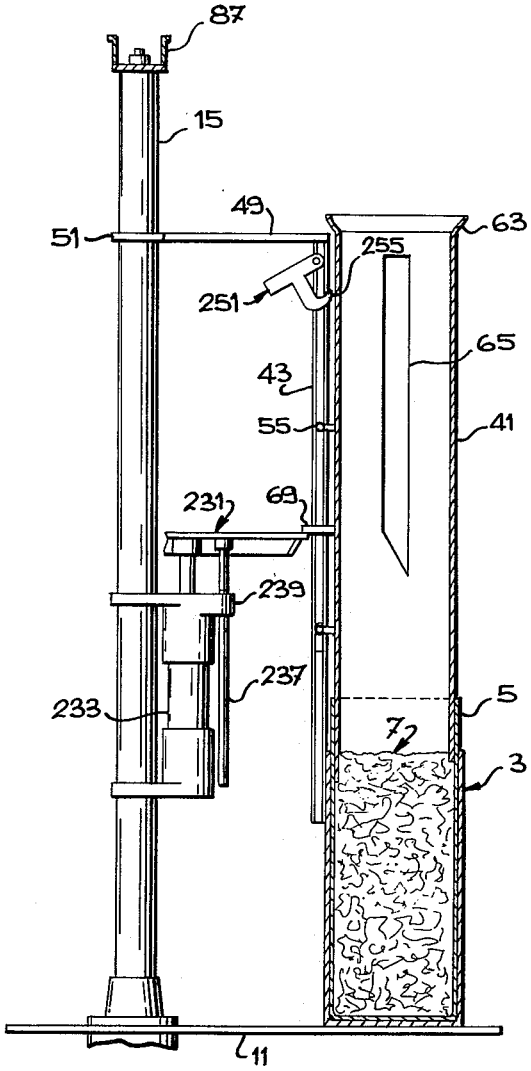
FIGS. 11 and 12 are detail views of the closing station.
Figure 12:
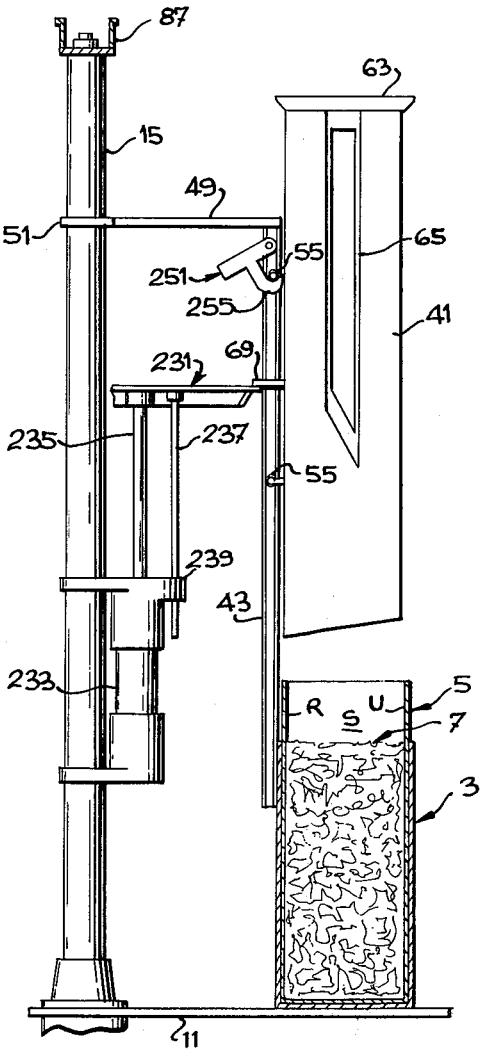

At station "D," the loading tube 41 is raised from its bottom position, within container 5 shown in FIG. 11, to its top position, clear of the container 5, as shown in FIG. 12. Cylinder 233 is operated to lift platform 231, including its portion 243, thus lifting plate 69, and attached tube 41 up guide beams 43. As tube 41 is being raised to its top position, top restraining rod 55 on the back of tube moves up past hook 255, camming it out about pin 253. Hook 255 moves back in after rod 55 passes it. Now when platform 231 is lowered, to lower another loading tube into another holding means for loading a new container at station "A," (as shown in FIG. 8), the loading tube 41 at station "D" remains raised above loaded container 5, held up by rod 55 caught by hook 255.

The material 7 remains substantially compressed during this short period and at station "D" the top of the container is then folded closed and fastened. First, folding means 107 is operated to fold the upper portion R of the back wall of the container. Cylinder 133 is actuated to slide closure plate 115 forward along rails 117. When runners 121, guiding plate 115 on rails 117, hit stop 131, continued actuation of cylinder 133 pivots plate 115 down flat about the rod 125 joining runners 121 thus folding wall portion "R" down onto the flat top of the compressed material as shown in FIG. 4. Cylinder 133 is then actuated to withdraw plate 115 back from container 5 along rails 117, spring 145 serving to help raise the plate about rod 125 as it is returned to its non-operative position, as shown in FIG. 3.

Folding means 109 are next operated to fold in the top portions "S," "T" of the sidewalls of the container over on top of folded backwall portion R. The folding means 109 are actuated by operation of cylinder 179 moving plates 151 forward along either side of holding means 3 just above its top edge 119. As plates 151 move forward, the offset cam members 169 contact the front wall 23A of holding means 3 and pivot plates 151 inwardly about pivot pins 153 as shown in FIG. 2. This inward pivoting movement wipes, or folds, the top portions "S," "T" of the container sidewalls inwardly and down over wall portion "R." When the cylinder 179 is actuated to withdraw plates 151, spring 175 pivots the plates 151 about pins 153 back to their initial position.

Folding means 111 are then operated to complete the folding operation. Cylinder 203 is first operated to slide clamping plate 193 forward. As plate 193 passes off the front edge of top plate 191, spring 199 snaps it down tight against front plate 185, pivoting it about pin 197, and clamping the top portion "U" of the front wall of container 5 therebetween. Cylinders 209 are then actuated to move support assembly 183 forward as shown in FIG. 6. Front wall portion "U" is thus drawn over folded wall portions "R," "S" and "T," sliding out from between clamping plate 193 and front plate 185. Just before wall portion "U" is completely pulled out from plates 193, 185, cylinder 221 is actuated to press the closing means 215 down against folded wall portions U, S, T and R and fasten them together. If the container is made from heat sealable plastic material, the closing means 215 can comprise an electric heating device for heat sealing the folded container wall portions together. If the container is made from paper material, the closing means 215 can comprise one or more stapling devices.

After the folded container is fastened, cylinder 221 is actuated to raise the closing means, cylinders 209 are actuated to withdraw assembly 183, and cylinder 203 is actuated to slide clamping plate 193 back to a horizontal position.

Platform 11 is now again rotated to move holding means 3, and raised loading tube 41, to station "A." At station "A," clamp 29 is unclamped, and walls 23A, 23B are opened with the filled container 5 riding out on shelf 27 to be unloaded as shown in FIG. 7. Also at this station "A," cylinder 247 is actuated to raise cam plate 249 against the free arm of the T-shaped retaining member 251 thereby pivoting it about pin 253 to disengage hook 255 from rod 55. In order for cylinder 247 to be effective in unlatching loading tube 41, the platform 231 must be in a raised position. This occurs when the platform 231 is raised to lift the following loading tube at station "D" above the next container prior to folding it. With tube 41 at station "A" unlatched, platform 231 is then lowered to lower tube 41 into the open container 3 initiating a new cycle.

It will be understood that an operation occurs at each station A, B, C and D substantially simultaneously and that each operation, except for the initial positioning of the container in holding means 3, and its final removal, loaded, from shelf 27, both at station "A," is performed automatically in the required sequence. Thus the apparatus can package compressible material extremely quickly.

I claim:

1. A method for packaging compressible material into a flexible-walled container on an intermittently rotating support carrying a holding means and an associated, vertically movable loading tube located above the holding means, said support being operable to position said holding means and its associated loading tube at each of a series of four work stations, and said method including the steps of:

beginning with said holding means and its associated loading tube located at a first of said four work stations and with said loading tube in its lowered position, positioning the container to be filled inside said holding means with a top portion thereof drawn up around the bottom end of the lowered loading tube, said holding means having rigid walls for confining the container to a desired, filled shape;

operating said support to move said holding means and its associated loading tube to a second work station;

delivering a predetermined quantity of said compressible material through said lowered loading tube and into said container said quantity being in excess relative to the container;

operating said support to move said holding means and its associated loading tube to a third work station;

compressing the material down said lowered loading tube and into the container;

operating said support to move said holding means and its associated loading tube to a fourth work station;

raising the loading tube, and thereafter folding the top portion of the filled container over the upper surface of the compressed material to close the container;

operating said support to move said holding means and its associated loading tube back to said first work station; and removing the closed, filled container from the holding means, after which said loading tube is lowered in preparation for the start of another operating cycle.

2. A method as claimed in claim 1, wherein there are four holding means and associated loading tubes, said support being operable to move each of said four holding means and its associated loading tube in sequence past said four work stations.

3. A method as claimed in claim 1, wherein the loading tube at said first work station is lowered until an upper end portion of the holding means overlaps the bottom end of the loading tube.

4. A method as claimed in claim 1, wherein the top portion of the container defines a back wall, sidewalls and a front wall, and wherein in said folding step at said fourth work station the container back wall is first folded down onto the upper surface of the compressed material, the sidewalls are then folded over, and finally the front wall is loosely clasped by a gripping means which is moved over the top of the container to draw the front wall over the folded sidewalls as it slides out of the gripping means.

5. An apparatus for packaging compressible material into a flexible-walled container, said apparatus having four work stations, and including:

an intermittently rotating support;

a holding means and an associated, vertically movable loading tube located above the holding means, said holding means and said loading tube being carried by said support, said loading tube being movable between lowered and raised positions, and said support being arranged and operable to position said holding means and its associated loading tube in sequence at each of said four work stations;

said holding means being adapted to receive and support a container to be filled when the holding means is positioned at a first one of said work stations and when its associated loading tube is in its lowered position, with a top portion of said container drawn up around the bottom end of said loading tube, said holding means having rigid walls for confining the container to a desired, filled shape;

means at a second of said work stations, operable to deliver a predetermined quantity of said compressible material through said loading tube and into said container when said support has been operated to move said holding means and its associated loading tube to said second station, the quantity of compressible material being in excess relative to the container;

means at a third of said work stations, operable to compress the material down the loading tube and into the container, when said support has been operated to move said holding means and its associated loading tube from said second work station to said third work station;

first and second means at a fourth of said work stations arranged and operable, respectively, to raise the loading tube to its raised position and to fold the top portion of the filled container over the upper surface of the compressed material, thereby closing the container, when said support has been operated to move said holding means and its associated loading tube from said third work station to said fourth work station; and means arranged to retain the loading tube in its raised position at said fourth work station and during movement of said holding means and its associated loading tube back to said first work station, whereby to allow unloading at said first work station of the closed, filled container from said holding means, said support being operable to effect such movement from said fourth work station to said first work station, and said loading tube raising means at said fourth work station extending to said first work station and cooperating with means at said first work station arranged to release said loading tube retaining means, whereby to cause lowering of said loading tube towards its associated holding means, for receiving around its bottom end another container to be filled.

6. An apparatus as claimed in claim 5, wherein said holding means comprises four rigid walls defining a quadrangular shape, two adjacent walls forming one wall unit, and the other two adjacent wall units forming a second wall unit, said one wall unit being hinged to said second wall unit whereby to allow opening of said holding means.

7. An apparatus as claimed in claim 6, wherein said four rigid walls extend vertically up from said rotating support, said one wall unit being fixed to said support, and said second wall unit being hinged to said one wall unit along a vertical axis.

8. An apparatus as claimed in claim 7, wherein said second wall unit has a bottom shelf for supporting said container.

9. An apparatus as claimed in claim 5, including four holding means and associated loading tubes, mounted equally spaced-apart in a circle on said support, and arranged to be rotated by said support about a vertical axis coinciding with the center of said circle.

10. An apparatus as claimed in claim 5, wherein the top portion of said container defines a back wall, sidewalls and a front wall, and wherein said folding means at said fourth work station comprises first means constructed and arranged to fold the back wall down onto the upper surface of the compressed material, second means constructed and arranged to fold the sidewalls over the folded back wall, and third means constructed and arranged to fold the front wall onto the folded sidewalls.

11. An apparatus as claimed in claim 10, wherein said third folding means includes: means constructed and arranged to loosely grip said front wall; and means constructed and arranged to move said gripping means over the top of said container, whereby to cause the front wall to slide out of said gripping means as it is folded over the folded sidewalls.

12. An apparatus as claimed in claim 11, wherein said gripping means comprises: a first, fixed vertical plate; a second, movable plate mounted horizontally above said first plate; and means for horizontally moving said second plate to a position where it can be moved to a vertical position adjacent said first plate, and biased thereagainst to grip said front wall.

13. An apparatus as claimed in claim 5, further including: means at said fourth station constructed and arranged to fasten the folded walls of said container.

14. An apparatus as claimed in claim 13, further including: means arranged and operable for moving fastening means towards or away from said container.

15. An apparatus as claimed in claim 5, wherein said loading tube is slidably mounted on a pair of spaced-apart vertical guide beams, stop means being provided on a lower portion of each guide beam to limit the extent of downward movement of the loading tube to its lowered position, wherein an upper end portion of said holding means overlaps the bottom end of said loading tube.

16. An apparatus as claimed in claim 15, wherein said raising means comprises: a lifting platform mounted between said fourth and first work stations, and having a first lifting portion adjacent said first work station, and a second lifting portion adjacent said fourth work station, each of said lifting portions being adapted to cooperate with a lifting plate mounted on said loading tube; and first fluid pressure means mounted and operable for actuating a vertically movable piston rod connected to said platform.

17. An apparatus as claimed in claim 16, wherein said retaining means comprises: a T-shaped member pivotally mounted on said guide beams, and having a hook portion normally lying in the path of movement of a cross bar on said loading tube, said hook portion being adapted to receive said cross bar in latching engagement.

18. An apparatus as claimed in claim 17, wherein said releasing means comprises: second fluid pressure means mounted on said lifting platform at said first lifting portion thereof, and operable for actuating a second, vertically movable piston rod having an upper end adapted to cooperate with said T-shaped member to disengage said hook portion from said cross bar, whereby to unlatch said loading tube so that it can move from its raised to its lowered position.

19. An apparatus for packaging compressible material into a flexible-walled container, comprising:

an intermittently rotating platform carrying at least one container holding means having an associated, vertically movable material loading means mounted thereabove, said platform being operable to move said holding means and its associated loading means to a number of work stations wherein at least one different packaging operation is performed at each work station, said holding means and associated loading means being equal in number to the number of work stations and being mounted equally spaced-apart in a circle on said platform for rotation with said platform about a vertical axis coinciding with the center of said circle, and each of said holding means having rigid walls for confining a container received therein for filling to the desired, filled shape;

means arranged and operable for vertically moving said loading means between a lowered position adjacent its associated holding means, and a raised position spaced above therefrom; and means at one of said work stations for closing a container carried by said holding means and filled with compressed material, said container having a top portion upstanding from the upper surface of the compressed material contained therein, and said top portion defining a back wall, sidewalls, and a front wall, said closing means comprising:

first means constructed and arranged to fold said back wall down onto the upper surface of said compressed material;

second means constructed and arranged to fold said sidewalls over the folded back wall; and third means constructed and arranged to fold the front wall onto the folded sidewalls, said third folding means including: means constructed and arranged to loosely grip said front wall; and means constructed and arranged to move said gripping means over the top of said container, whereby to cause said front wall to slide out of said gripping means as it is folded over said folded sidewalls.

20. An apparatus as claimed in claim 19, wherein said gripping means comprises: a first, fixed vertical plate; a second, movable plate mounted horizontally above said first plate; and means for horizontally moving said second plate to a position where it can be moved to a vertical position adjacent said first plate, and biased thereagainst to grip said front wall.

* * * * *